US009627771B2

(12) United States Patent
Schreider et al.

(10) Patent No.: US 9,627,771 B2
(45) Date of Patent: Apr. 18, 2017

(54) METHOD FOR MANUFACTURING AN ANTENNA REFLECTOR WITH SHAPED SURFACE, REFLECTOR WITH SHAPED SURFACE OBTAINED BY THIS METHOD AND ANTENNA COMPRISING SUCH A REFLECTOR

(71) Applicant: THALES, Neuilly-sur-Seine (FR)

(72) Inventors: Ludovic Schreider, Toulouse (FR); Philippe Lepeltier, Toulouse (FR); Isabelle Faro, Toulouse (FR); Serge Depeyre, Blagnac (FR); Jean-Philippe Taisant, Paris (FR)

(73) Assignee: THALES, Courbevoie (FR)

( * ) Notice: Subject to any disclaimer, the term of this patent is extended or adjusted under 35 U.S.C. 154(b) by 264 days.

(21) Appl. No.: 14/290,799

(22) Filed: May 29, 2014

(65) Prior Publication Data

US 2014/0354501 A1 Dec. 4, 2014

(30) Foreign Application Priority Data

May 31, 2013 (FR) ..... 13 01239

(51) Int. Cl.
*H01Q 15/14* (2006.01)
*H01Q 1/28* (2006.01)
(Continued)

(52) U.S. Cl.
CPC ..... *H01Q 15/14* (2013.01); *H01Q 1/288* (2013.01); *H01Q 15/141* (2013.01);
(Continued)

(58) Field of Classification Search
CPC .... H01Q 15/14; H01Q 15/141; H01Q 15/142; H01Q 15/147; H01Q 15/168; H01Q 19/10; H01Q 1/288
See application file for complete search history.

(56) References Cited

U.S. PATENT DOCUMENTS 3,184,210 A 5/1965 Fassnacht et al.
4,750,002 A 6/1988 Kommineni
(Continued)

FOREIGN PATENT DOCUMENTS

EP 2362489 A1 8/2011
EP 2503641 A1 9/2012
(Continued)

OTHER PUBLICATIONS

Masashi Shimizu, et al., "Study of Shape Control for Modular Mesh Antenna", Electronics and Communications in Japan, Part 1, Dec. 1, 1996, pp. 185-191, vol. 79, No. 12, Wiley, Hoboken, NJ, USA, XP000679207.

*Primary Examiner* — Hoang V Nguyen
(74) *Attorney, Agent, or Firm* — Baker and Hostetler LLP

(57) ABSTRACT

A method is provided which includes: defining at least one radiofrequency performance objective to be produced on a selected coverage area on the ground; producing a rigid shell having a predefined profile; producing a reflecting flexible membrane; determining, by successive iterations, N optimum local deformations to be applied at N different points of the flexible membrane; producing N rigid supporting bars of different lengths corresponding to the optimum local deformations to be applied to the flexible membrane; and positioning and rigidly fixing the flexible membrane onto the rigid shell via the N supporting bars.

13 Claims, 5 Drawing Sheets

(51) Int. Cl.
*H01Q 15/16* (2006.01)
*H01Q 19/10* (2006.01)

(52) U.S. Cl.
CPC ..... *H01Q 15/142* (2013.01); *H01Q 15/147* (2013.01); *H01Q 15/168* (2013.01); *H01Q 19/10* (2013.01); *Y10T 29/49016* (2015.01)

(56) References Cited

U.S. PATENT DOCUMENTS

| | | | | |
|---|---|---|---|---|
| 5,440,320 | A * | 8/1995 | Lach | H01Q 15/147 343/912 |
| 8,860,627 | B2 * | 10/2014 | Scolamiero | H01Q 1/08 343/761 |
| 2012/0092225 | A1 * | 4/2012 | Schreider | H01Q 15/147 343/834 |
| 2013/0076590 | A1 | 3/2013 | Baudasse et al. | |

FOREIGN PATENT DOCUMENTS

| | | | |
|---|---|---|---|
| FR | 2678111 | A1 | 12/1992 |
| JP | 2006080578 | A | 3/2006 |

* cited by examiner

METHOD FOR MANUFACTURING AN ANTENNA REFLECTOR WITH SHAPED SURFACE, REFLECTOR WITH SHAPED SURFACE OBTAINED BY THIS METHOD AND ANTENNA COMPRISING SUCH A REFLECTOR

CROSS-REFERENCE TO RELATED APPLICATION

This application claims priority to foreign French patent application No. FR 1301239, filed on May 31, 2013, the disclosure of which is incorporated by reference in its entirety.

FIELD OF THE INVENTION

The present invention relates to a method for manufacturing a reflector with shaped surface, a reflector with shaped surface obtained by this method and an antenna comprising such a reflector with shaped surface. It applies to the field of passive satellite telecommunications antennas and more particularly to the field of Ku band or C band telecommunications.

BACKGROUND

To obtain a radiofrequency pattern that has a predefined outline, it is known practice to use a single feed associated with a system of single or double reflector(s) with shaped surface, that is to say a surface having a specific geometry defining, on the ground, a specific coverage area having a non-circular outline, for example a country or a group of countries. The optical path variations between the feed and the different points of the reflector make it possible to generate beams that have a phase and amplitude pattern corresponding to the characteristics of the desired radiofrequency pattern.

It is also possible, with only one reflector and by using two feeds placed as close as possible to the focus of the reflector, to obtain two different radiofrequency patterns making it possible to cover two different geographic coverage areas.

A reflector with shaped surface is generally manufactured by using a dedicated mould whose shape corresponds to a predetermined antenna coverage. For each new coverage, it is therefore necessary to remake a specific mould. For the mould to not be deformed at temperature during baking and make it possible to produce a reflector that has the specified profile, the moulds used are made of a material with low coefficient of thermal expansion CTE, for example a material comprising carbon fibres or a material consisting of a steel alloy such as Invar (registered trade mark) consisting of iron and nickel alloy fibres. The problem is that, for operation in the Ku band, it is necessary to achieve a very fine manufacturing accuracy involving a high number of iterations during which the profile of the mould is reworked and refined. Thus, for a reflector with a typical diameter of two meters the mould production time is between four to six months. So in order not to delay the development of a new satellite, the choice of the coverage area and the associated shaped surface of the reflector to be produced is therefore defined very early in the programme progress. The mould production time is therefore a very important constraint in the progress of a programme and, after the production of the mould has been launched, there is no longer any flexibility for subsequently redefining the coverage area to be produced.

To resolve this flexibility problem, a solution could consist in using a reconfigurable reflector by using a deformable reflecting surface. There are different types of deformable reflecting surfaces such as, for example, a flexible surface formed on a knitted fabric or a mesh fabric as described notably in the document FR 2 678 111 or a flexible surface using carbon fibres bound by a silicone or a flexible surface using a grid of orthogonal stiff wires whose edges are free, the grid being maintained and stressed to a predetermined shape only by control points.

It is also known, from the document EP 2 362 489, to produce a deformable reflecting membrane with high radiofrequency reflectivity comprising an alternating superposition of layers of conductive elastomer and at least two discontinuous reinforcing layers. This membrane allows for significant deformations in multiple directions in-plane and off-plane of the surface of the membrane, has a sufficient bending stiffness and a low thermal expansion coefficient allowing for a dimensional stability of the membrane over a temperature range compatible with a space application, and a good electrical homogeneity so as not to create passive intermodulation signals which could damage the receiving quality of the antenna. The membrane can be reconfigured by means of mechanical actuators.

However, the reconfigurable reflectors require the presence of a large number of mechanical actuators, fixed onto the bottom surface of the membrane at chosen positions, which push or pull on the membrane to deform it and give it the desired shape. These mechanical actuators often comprise rotary drive electric motors that can be coupled either with a ball joint, or with a nut system associated with a worm screw, the nut being fixed onto the membrane. The problem is that the presence of a large number of actuators significantly increases the cost of production of the reflector and its weight which is prejudicial in the case of a space application (particularly for a mission which does not require any reconfiguration).

SUMMARY OF THE INVENTION

The aim of the invention is to produce a method for producing a reflector with shaped surface which cannot be reconfigured in service and which does not exhibit the drawbacks of the existing production methods, which does not require the production of a specific mould for each desired antenna coverage area, which does not include actuators, which makes it possible to very significantly reduce the production time of the reflector and delay, during the start-up of a satellite programme, the moment when the choice of geographic coverage area on the ground has to be set.

For this, the invention relates to a method for manufacturing an antenna reflector with shaped surface, the reflector comprising a flexible membrane having a front face with reflecting surface and being intended to be mounted in an antenna having a predetermined architecture, the method consisting:

- in defining at least one radiofrequency performance objective to be produced on a selected geographic coverage area on the ground,
- in producing a rigid shell having a predefined profile,
- in producing the flexible membrane,
- from the shape of the profile of the rigid shell and from an initial shape of the reflecting surface of the flexible membrane, in determining, by successive iterations, using a mechanical finite element model of the reflector and a radiofrequency model of the antenna, N optimum local deformations to be applied at N different points of the flexible membrane, in which N is an integer number greater than 1, the N optimum local deformations being determined by minimizing the radiofrequency performance deviations delivered on each iteration by the radiofrequency model of the antenna, in relation to the radiofrequency performance objectives to be produced on the selected geographic coverage area, in producing N rigid supporting bars of different lengths, each length corresponding to an optimum local deformation value to be applied to the flexible membrane, in positioning and rigidly fixing the flexible membrane onto the rigid shell via the N supporting bars.

Advantageously, the N supporting bars can be spaced apart from one another and fixed onto a rear face of the flexible membrane at N different supporting points of the flexible membrane.

Advantageously, the N supporting bars can also have different angles of inclination relative to the surface of the flexible membrane.

Advantageously, on each iteration, the mechanical model determines a deformed surface of the flexible membrane corresponding to local deformation values applied to the flexible membrane, and the radiofrequency model analyses radiofrequency performance levels on the geographic coverage produced on the ground corresponding to the deformed surface generated by the mechanical model.

Advantageously, on each iteration, the deviations between the radiofrequency performance levels delivered by the radiofrequency model and the radiofrequency performance objectives are calculated at different points of the coverage area on the ground and compared to a maximum threshold and, when the deviations are greater than the maximum threshold, a deviation minimizing algorithm is used to define new local deformation values of the flexible membrane making it possible to minimize, on the next iteration, the deviations obtained and to converge towards the radiofrequency performance objectives.

Advantageously, in the case where radiofrequency performance objectives have to be produced on two different geographic areas, the method consists in determining the N optimum local deformations to be applied at N different points of the flexible membrane by minimizing the radiofrequency performance deviations obtained on each iteration relative to the radiofrequency performance objectives to be produced on the two selected geographic coverage areas.

The invention relates also to a reflector with shaped surface obtained by this method, the reflector comprising a rigid shell having a predefined profile, a flexible membrane with deformable surface and with reflecting front face, N rigid supporting bars of predetermined different fixed lengths, the lengths of the N supporting bars corresponding to N optimum local deformations to be applied to the flexible membrane at N supporting points to obtain predetermined radiofrequency performance levels, the flexible membrane being fixed onto the rigid shell via the N supporting bars.

Advantageously, the N supporting bars are spaced apart from one another and fixed onto a rear face of the flexible membrane at N different supporting points of the flexible membrane.

Advantageously, the N supporting bars can have a square or circular section.

Advantageously, the N supporting bars can be distributed according to a regular square or hexagonal or triangular mesh.

Alternatively, the N supporting bars can be distributed according to an irregular mesh.

Advantageously, the flexible membrane can comprise, in thickness in a direction Z, at least one internal layer consisting of a carbon fibre fabric, the carbon fibres being arranged parallel to a plane XY of the flexible membrane and extending in two orthogonal directions, and a reflecting outer layer consisting of a conductive elastomer material, the conductive elastomer material consisting of a material made of silicone charged with metal or carbon particles.

The invention relates also to an antenna comprising at least one such reflector with shaped surface.

BRIEF DESCRIPTION OF THE DRAWINGS

Other features and advantages of the invention will become clearly apparent from the rest of the description given as a purely illustrative nonlimiting example, with reference to the attached schematic drawings which represent.

DETAILED DESCRIPTION

Figure 1:
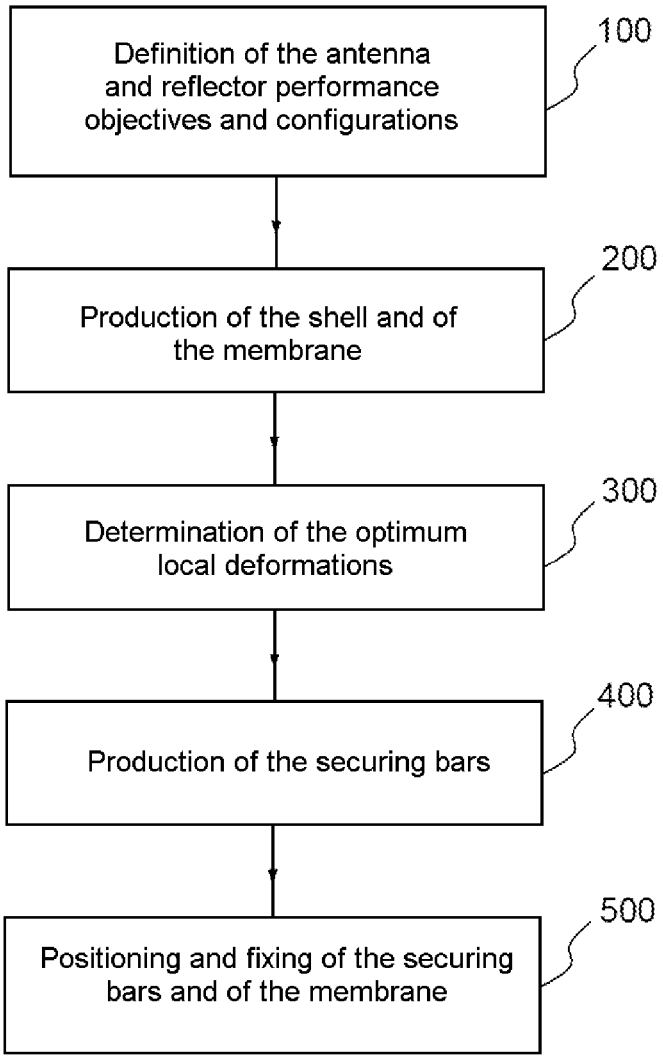
FIG. 1: a block flow chart diagram of the method for producing the reflector, according to the invention.

As represented in the block flow chart of FIG. 1, the invention consists, in a first step 100, in defining radiofrequency performance objectives to be produced on a selected geographic coverage area on the ground and in selecting an antenna architecture and a reflector structure. To significantly reduce the production time of the reflector with shaped surface, the invention consists in defining a novel reflector structure with shaped surface that can be produced from a rigid preform with predefined surface obtained by moulding in a standard reflector mould and forming a rigid support onto which will be fixed a flexible membrane via rigid supporting bars.

In a step 200, the rigid preform and the flexible membrane are produced. The rigid preform preferably consists of a thick rigid shell having a predefined profile such as, for example, a parabolic profile.

In a step 300, the invention consists, from the mechanical properties of the flexible membrane and at least one radiofrequency performance objective to be observed at each point of the geographic coverage area to be produced on the ground, in choosing the number and the positions of the supporting points to be applied to the rear surface of the flexible membrane and in defining, by successive iterations, optimum local deformations to be applied to the flexible membrane at the different supporting points to obtain a radiofrequency pattern of the antenna having performance levels corresponding to the objectives set on the selected coverage area on the ground. Local deformations applied to the membrane, at each supporting point, depend directly on the different lengths of each corresponding supporting bar. The local deformations to be applied to the membrane are optimized by the optimization method represented in the block flow chart diagram of FIG. 2.

In a step 400, from the deformed surface obtained in step 300 and with the corresponding supporting bar parameters, the supporting bars are produced, each supporting bar being cut to the required length corresponding to the optimum local deformations to be applied to the membrane.

In a step 500, the placement of each supporting bar is identified on the surface of the shell of the reflector. For example, the supporting bars can be distributed regularly on the surface of the shell of the reflector and according to a square or hexagonal or triangular mesh. Alternatively, the supporting bars can also be distributed according to an irregular mesh which makes it possible to improve the radiofrequency performance levels of the antenna. It is also possible to use a foam product positioning template to assist in the accurate positioning of the supporting bars. The foam product template can be produced by machining and comprises holes facilitating access to the links of the bars. The foam product template is positioned on the surface of the shell of the reflector and can comprise an imprint identifying the positions of the second ends of the supporting bars on the flexible membrane. A first end of each supporting bar is then positioned and glued onto the surface of the shell of the reflector, in the positions previously identified. For example, the supporting bars may comprise a square or circular section to facilitate their positioning. The flexible membrane is then glued to each second end of the supporting bars. The mounting is produced without stress by virtue of the orientation and the adequate length of the supporting bars.

Figure 2:
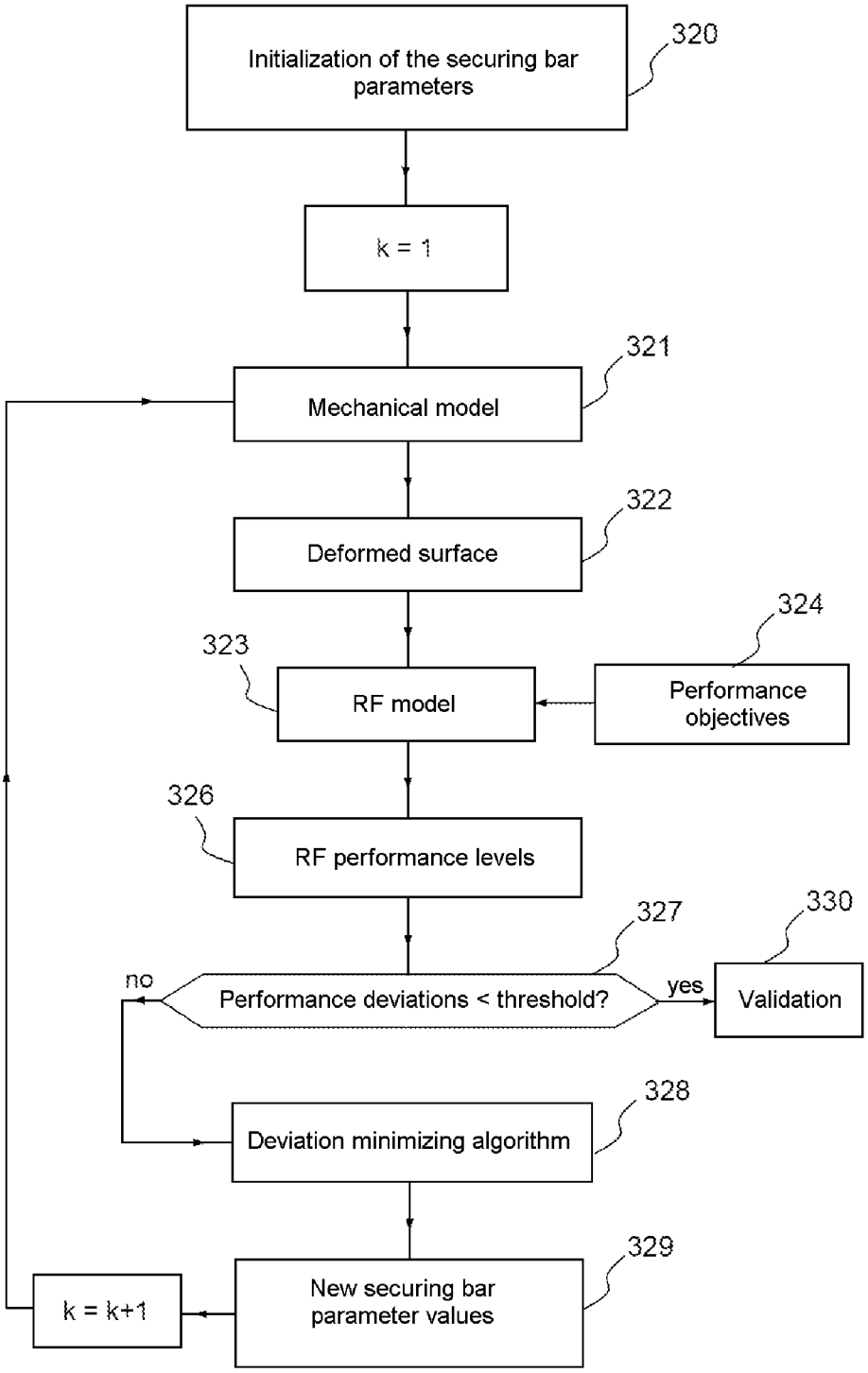
FIG. 2: a block flow chart diagram of the method for optimizing the shape of the surface of the membrane of the reflector, according to the invention.

As represented in FIG. 2, the optimization method used in the step 300 comprises an initialization step 320 in which the initial parameters of the supporting bars are defined. These parameters initially selected for each supporting point of the flexible membrane are the number, the position, the lengths and, possibly, the angle of inclination of the supporting bars. Successive iterative loops then make it possible, from the initial shape of the surface of the membrane defined by the initial parameters of the supporting bars at each supporting point, to optimize the parameters of the supporting bars, and in particular their respective lengths at the different membrane supporting points to achieve the radiofrequency performance levels set.

On each iteration k, the optimization method uses a mechanical model 321 of the reflector which determines a deformed surface area 322 of the membrane and a radiofrequency RF model 323 which determines and analyses the radiofrequency performance levels 326 on the geographic coverage area produced on the ground corresponding to the deformed surface 322 generated by the mechanical model 321.

The mechanical model 321 is a finite element model comprising N supporting points, where N is an integer number greater than one, and takes account of the geometry of the selected reflector, of the material chosen for the membrane and of the deformation properties of the membrane. The mechanical model 321 makes it possible, on each iteration k concerned, from an assumption concerning the deformation values applied locally at the different supporting points of the membrane, to determine the shape of the surface of the membrane corresponding to the locally applied deformations. From the shape of the surface of the membrane delivered by the mechanical model 321 on the iteration k considered, the radiofrequency model 323 then determines the performance levels 326 of the radiofrequency pattern of the antenna obtained on the geographic coverage area on the ground to be produced. Deviations 327 between the radiofrequency performance levels obtained and the set performance objective 324 are then calculated at different points of the coverage area on the ground and compared to a maximum threshold. When the deviations are greater than the maximum threshold, a deviation minimizing algorithm 328 is used to define a new assumption of values of the parameters of the supporting bars 329, corresponding to new local deformation values to be applied to the membrane, making it possible to minimize, on the next iteration k+1, the deviations obtained and to converge towards the objective set. The supporting bar parameter values are validated in the step 330 when the performance deviations obtained on the last iteration are considered below the maximum threshold.

The objective set can relate to performance levels of one or more parameters of the radiofrequency pattern of the antenna such as, for example, in the case of an antenna operating in double linear polarization mode, an objective concerning a maximum level and a minimum level of co-polarization and an objective relating to a maximum level of cross-polarization. When the performance levels to be produced relate to several different parameters, the performance level objectives corresponding to the different parameters can be weighted by different weights. The optimization can also be produced for several different frequencies.

In the case where the reflector has to cover two different geographic coverage areas by using two feeds placed as close as possible to the focus of the reflector, the performance objectives to be produced on the two geographic coverage areas are taken into account and the optimization is produced by following the same steps for each coverage area.

In this case, the method consists in defining performance objectives to be produced on the two different geographic areas and in determining the N optimum local deformations 14 to be applied at N different points of the flexible membrane by minimizing the radiofrequency performance deviations obtained on each iteration k relative to the radiofrequency performance objectives to be produced on the two selected geographic coverage areas.

Different performance deviation minimizing algorithms can be used. For example, it is possible to use the optimization algorithm, called MiniMax algorithm, consisting in minimizing the maximum value of m deviation functions fi(x), where each function fi is a performance deviation obtained relative to a set objective, m is the total number of objectives set, i is an integer number varying between 1 and m, x is a vector containing n variables corresponding to the respective lengths of the n supporting bars, m being greater than or equal to n. Instead of the MiniMax algorithm, it is also possible to use the optimization algorithm, called least squares algorithm, which consists in minimizing the sum of the squares of the m different deviation functions fi(x).

The initial shape of the membrane can, for example, be chosen to be a parabolic shape identical to the shape of the thick shell of the reflector, which corresponds to supporting bars of identical lengths.

Figure 5A:
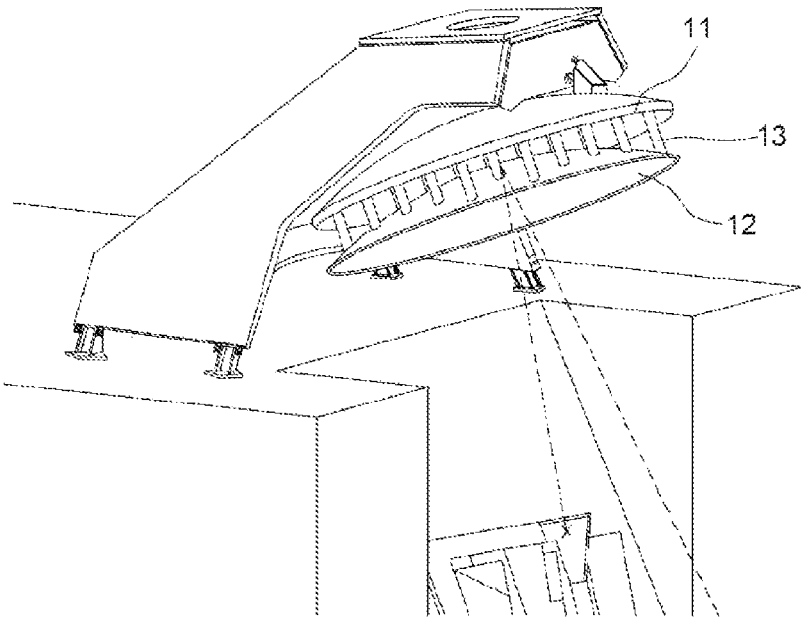
FIG. 5*a*: an exemplary offset simple antenna with a single reflector with a reflecting membrane mounted on the reflector, according to the invention.
Figure 5B:
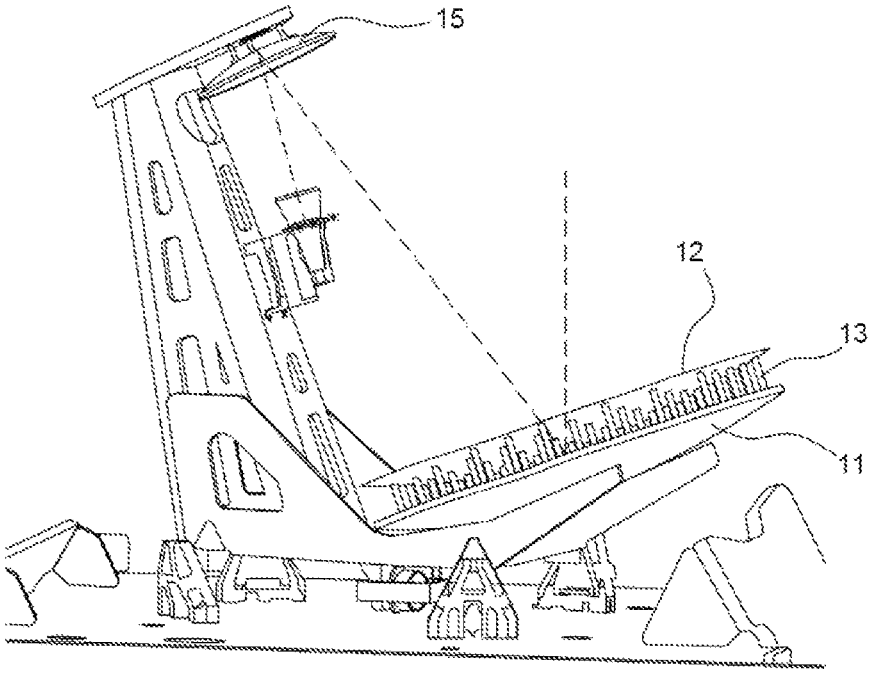
FIG. 5*b*: an exemplary Gregorian antenna with double reflector with a reflecting membrane mounted on the main reflector, according to the invention.

The chosen antenna architecture can, for example, be a simple offset antenna architecture and comprise a single reflector 10 as represented for example in FIG. 5*a*, or a Gregorian antenna architecture, as represented for example in FIG. 5*b*, and comprise a main reflector 10 and a subreflector 15. In the case of the use of a Gregorian antenna, the main reflector 10 is of shaped surface and is defined and manufactured in accordance with the production method of the invention. It is also possible to use a subreflector 15 with shaped surface.

Figure 3:
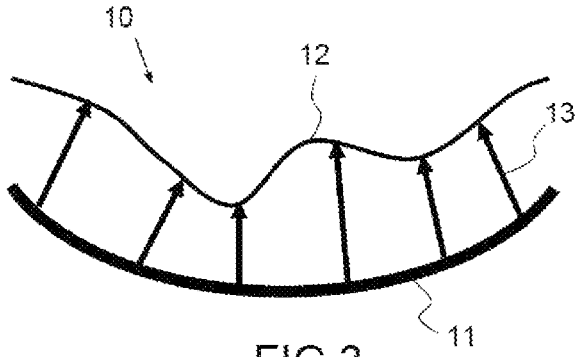
FIG. 3: a view, in transversal cross section, of an exemplary portion of antenna reflector, according to the invention.
Figure 4A:
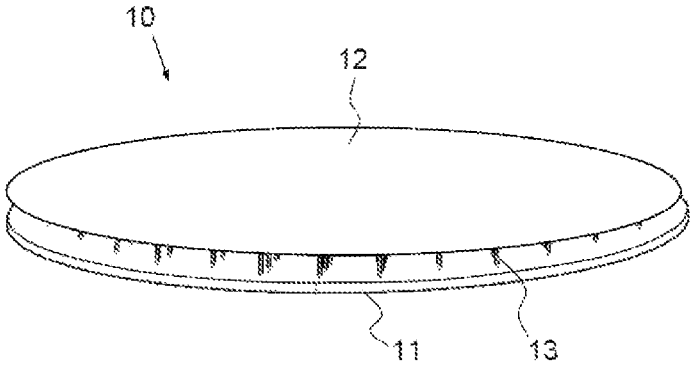
FIGS. 4*a* and 4*b*: two diagrams, in perspective, of an antenna reflector with shaped surface, according to the invention.
Figure 4B:
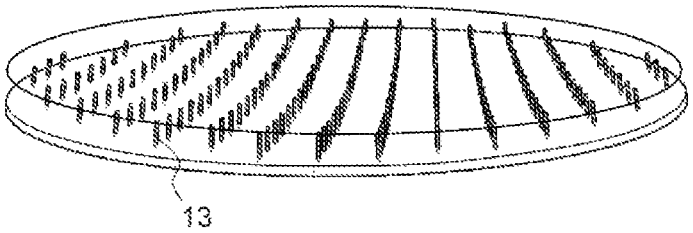

FIGS. 3, 4*a* and 4*b* represent an exemplary antenna reflector structure with shaped surface, produced in accordance with the production method of the invention. The reflector 10 comprises a rigid support consisting of a thick rigid shell 11 having a predefined front face, for example parabolic front face, and a flexible membrane 12, deformable and comprising a reflecting front face, the rear face of the flexible membrane being rigidly fixed onto the rigid shell 11 by N transverse supporting bars 13 of predetermined different lengths, where N is an integer number greater than one. The rigid shell of the reflector is produced by moulding in a standard reflector mould. The N supporting bars can also be positioned at different angles of inclination relative to the surface of the flexible membrane 12. Each supporting bar 13 comprises two opposing ends rigidly fixed respectively onto the front face of the rigid shell 11 and onto the rear face of the flexible membrane 12, by any known rigid fixing means, for example by gluing or riveting. The supporting bars 13 are spaced apart from one another and positioned at predetermined different supporting points. The supporting points can be located over the entire surface of the rear face of the flexible membrane 12 as represented in FIG. 4*b*, apart from a peripheral region of the flexible membrane which is not linked to the rigid shell 11 and remains free on the peripheral edges of the reflector 10. Since the flexible membrane 12 is free on the peripheral edges of the reflector 10, the supporting bars closest to the edges of the reflector define the deformations on the edges of the flexible membrane 12 and make it possible to optimize the cross polarization discrimination and the secondary lobes of the radiofrequency pattern of the antenna. As an example, a hexagonal distribution of the supporting bars makes it possible to better control the deformations on the edges of the flexible membrane than a square distribution. It is also possible to add some supporting bars to the peripheral edges of the reflector to improve the control of the peripheral region of the membrane. Each supporting bar 13 applies, at the point of fixing onto the reflecting flexible membrane 12, a local deformation 14 dependent on the length of the corresponding supporting bar 13. The reflecting front face of the flexible membrane 12 therefore takes on a shape which depends on the length of each supporting bar 13. The lengths of each supporting bar 13 are predetermined, at each supporting point, and defined according to the architecture and the dimensions of the antenna selected to accomplish the mission of the satellite and according to the desired radiofrequency performance levels so as to optimize the radiofrequency pattern of the antenna on the specified coverage area on the ground. After the supporting bars 13 have been fixed onto the rigid shell 11 of the reflector 10 and onto the flexible membrane 12, their respective lengths can no longer be modified and it is therefore no longer possible to modify the shape of the flexible membrane in flight after the satellite on which the antenna equipped with the reflector according to the invention is mounted has been placed in service.

The flexible membrane 12 can be fixed directly to the supporting bars 13 or via double ball-joint links with pawl or dry fibres. The use of double ball-joint links offers the advantage of allowing local movements of the membrane in its local plane and of minimizing the impact of the thermo-elastic effects on the deformed membrane and the corresponding stresses in the material of the membrane.

According to an exemplary embodiment, the shell 11 of the reflector 10 can be made of a composite material and comprise a multilayer structure, symmetrical in thickness, such as an internal honeycomb layer sandwiched between two outer carbon deposits. The supporting bars 13 can be made of carbon and have different lengths typically between 50 mm and 100 mm. The flexible membrane 12 can comprise, in thickness in a direction Z, one, or more, internal layers that can consist, for example, of a carbon fibre fabric, the carbon fibres being arranged parallel to the plane XY of the membrane and extending in two orthogonal directions, and a reflecting outer layer placed on the front face of the membrane, the outer layer being able to be made, for example, of a conductive elastomer material, the conductive elastomer material being able to consist of a silicone material resistant to particles radiations, for example electrons, and charged with metal or carbon particles. A conductive elastomer material has the advantage of having elastic properties which allow deformations of the membrane from its plane XY, unlike a pure metal material which can, under the effect of the thermo-elastic deformations, cause microcracks and become the potential source of intermodulation signals. Furthermore, a membrane of conductive elastomer or comprising layers of biaxial carbon fibre fabric and an outer layer of conductive elastomer material has very good radiofrequency reflectivity performance levels and generates very low intermodulation signals in the reception band. However, the use of charged silicone material on the front face of the membrane is not mandatory. This use depends on the specified level of intermodulation signals. Any other type of deformable membrane or of deformable fabric can be used as reflecting surface of the reflector.

Although the invention has been described in conjunction with particular embodiments, it is clear that it is in no way limited thereto and that it embraces all the technical equivalents of the means described and their combinations provided the latter fall within the context of the invention. In particular, any flexible reflecting membrane meeting the desired radiofrequency requirements can be used. The deformations or the surfaces accessible to the flexible membrane depend on the mechanical properties of said membrane, that is to say that two different flexible membrane technologies can culminate in different surfaces but comparable performance levels. Similarly, the rigid shell of the reflector can be made from a material other than that specifically described provided that it has the required mechanical properties for the mission to be carried out. The radiofrequency performance levels obtained with the reflector with flexible membrane are comparable to the performance levels obtained with the conventional shaped reflector technologies.

The invention claimed is:

1. A method for manufacturing an antenna reflector with shaped surface, the reflector comprising a flexible membrane having a front face with reflecting surface and being intended to be mounted in an antenna having a predetermined architecture, the method comprising:

defining at least one radiofrequency performance objective to be produced on a selected geographic coverage area on the ground;

producing a rigid shell having a predefined profile;

producing the flexible membrane;

from the shape of the profile of the rigid shell and from an initial shape of the reflecting surface of the flexible membrane, determining, by successive iterations, using a mechanical finite element model of the reflector and a radiofrequency model of the antenna, N optimum local deformations to be applied at N different points of the flexible membrane, in which N is an integer number greater than 1, the N optimum local deformations being determined by minimizing the radiofrequency performance deviations delivered on each iteration by the radiofrequency model of the antenna, in relation to the radiofrequency performance objectives to be produced on the selected geographic coverage area;

producing N rigid supporting bars of different lengths, each length corresponding to an optimum local deformation value to be applied to the flexible membrane; and positioning and rigidly fixing the flexible membrane onto the rigid shell via the N supporting bars;

wherein, on each iteration, the mechanical model determines a deformed surface of the flexible membrane corresponding to local deformation values applied to the flexible membrane, and wherein, the radiofrequency model analyses radiofrequency performance levels on the geographic coverage produced on the ground corresponding to the deformed surface generated by the mechanical model; and wherein, on each iteration, the deviations between the radiofrequency performance levels delivered by the radiofrequency model and the radiofrequency performance objectives are calculated at different points of the coverage area on the ground and compared to a maximum threshold, and wherein, when the deviations are greater than the maximum threshold, a deviation minimizing algorithm is used to define new local deformation values of the flexible membrane making it possible to minimize, on the next iteration, the deviations obtained and to converge towards the radiofrequency performance objectives.

2. The method for manufacturing an antenna reflector according to claim 1, wherein the N supporting bars are spaced apart from one another and fixed onto a rear face of the flexible membrane at N different supporting points of the flexible membrane.

3. The method for manufacturing an antenna reflector according to claim 2, wherein the N supporting bars further having different angles of inclination relative to the surface of the flexible membrane.

4. The method for manufacturing an antenna reflector according to claim 1, further comprising defining radiofrequency performance objectives to be produced on two different geographic areas and in determining the N optimum local deformations to be applied at N different points of the flexible membrane by minimizing the radiofrequency performance deviations obtained on each iteration relative to the radiofrequency performance objectives to be produced on the two selected geographic coverage areas.

5. A method for manufacturing an antenna reflector with shaped surface, the reflector comprising a flexible membrane having a front face with reflecting surface and being intended to be mounted in an antenna having a predetermined architecture, the method comprising:

defining at least one radiofrequency performance objective to be produced on a selected geographic coverage area on the ground;

producing a rigid shell having a predefined profile;

producing the flexible membrane;

from the shape of the profile of the rigid shell and from an initial shape of the reflecting surface of the flexible membrane, determining, by successive iterations, using a mechanical finite element model of the reflector and a radiofrequency model of the antenna, N optimum local deformations to be applied at N different points of the flexible membrane, in which N is an integer number greater than 1, the N optimum local deformations being determined by minimizing the radiofrequency performance deviations delivered on each iteration by the radiofrequency model of the antenna, in relation to the radiofrequency performance objectives to be produced on the selected geographic coverage area;

producing N rigid supporting bars of different lengths, each length corresponding to an optimum local deformation value to be applied to the flexible membrane; and positioning and rigidly fixing the flexible membrane onto the rigid shell via the N supporting bars;

wherein, on each iteration, the deviations between the radiofrequency performance levels delivered by the radiofrequency model and the radiofrequency performance objectives are calculated at different points of the coverage area on the ground and compared to a maximum threshold, and wherein, when the deviations are greater than the maximum threshold, a deviation minimizing algorithm is used to define new local deformation values of the flexible membrane making it possible to minimize, on the next iteration, the deviations obtained and to converge towards the radiofrequency performance objectives.

6. The method for manufacturing an antenna reflector according to claim 5, wherein the N supporting bars are spaced apart from one another and fixed onto a rear face of the flexible membrane at N different supporting points of the flexible membrane.

7. The method for manufacturing an antenna reflector according to claim 6, wherein the N supporting bars further having different angles of inclination relative to the surface of the flexible membrane.

8. The method for manufacturing an antenna reflector according to claim 5, further comprising defining radiofrequency performance objectives to be produced on two different geographic areas and in determining the N optimum local deformations to be applied at N different points of the flexible membrane by minimizing the radiofrequency performance deviations obtained on each iteration relative to the radiofrequency performance objectives to be produced on the two selected geographic coverage areas.

9. An antenna reflector with shaped surface obtained by the method according to claim 5, the reflector comprising a rigid shell having a predefined profile, a flexible membrane with deformable surface and with reflecting front face, N rigid supporting bars of predetermined different fixed lengths, the lengths of the N supporting bars corresponding to N optimum local deformations to be applied to the flexible membrane at N supporting points to obtain predetermined radiofrequency performance levels, the flexible membrane being fixed onto the rigid shell via the N supporting bars.

10. The antenna reflector with shaped surface according to claim 9, wherein the N supporting bars are spaced apart from one another and fixed onto a rear face of the flexible membrane at N different supporting points of the flexible membrane.

11. The antenna reflector with shaped surface according to claim 9, wherein the N supporting bars have a square or circular section.

12. The antenna reflector with shaped surface according to claim 9, wherein the N supporting bars are distributed according to a regular square or hexagonal or triangular mesh.

13. The antenna reflector with shaped surface according to claim 9, wherein the N supporting bars are distributed according to an irregular mesh.

* * * * *